US011268174B1

(12) United States Patent
Cheung et al.

(10) Patent No.: US 11,268,174 B1
(45) Date of Patent: Mar. 8, 2022

(54) JEWELRY ALLOY

(71) Applicant: CHOW SANG SANG JEWELLERY COMPANY LIMITED, Hong Kong (CN)

(72) Inventors: Wai Kei Cheung, Hong Kong (CN); Shuk Kwan Mak, Hong Kong (CN); Mei Tsz Macy WONG, Hong Kong (CN)

(73) Assignee: CHOW SANG SANG JEWELLERY COMPANY LIMITED, Hong Kong (CN)

( * ) Notice: Subject to any disclaimer, the term of this patent is extended or adjusted under 35 U.S.C. 154(b) by 0 days.

(21) Appl. No.: 17/382,396

(22) Filed: Jul. 22, 2021

(30) Foreign Application Priority Data

Jun. 10, 2021 (HK) ..... 32021032903.5

(51) Int. Cl.
*C22C 28/00* (2006.01)

(52) U.S. Cl.
CPC ..... *C22C 28/00* (2013.01)

(58) Field of Classification Search
None
See application file for complete search history.

(56) References Cited

U.S. PATENT DOCUMENTS

| | | | | |
|---|---|---|---|---|
| 4,911,762 | A | 3/1990 | Steinemann | |
| 6,500,282 | B2 | 12/2002 | Morris | |
| 6,929,776 | B1 | 8/2005 | Loh | |
| 2001/0026770 | A1 | 10/2001 | Morris et al. | |
| 2002/0122741 | A1 | 9/2002 | Prasad et al. | |
| 2013/0259736 | A1* | 10/2013 | Dyment | C22C 1/02 420/510 |

FOREIGN PATENT DOCUMENTS

| | | | |
|---|---|---|---|
| CN | 1420939 | A | 5/2003 |
| CN | 102676864 | A | 9/2012 |
| CN | 107760896 | A | 3/2018 |
| CN | 108660333 | A | 10/2018 |
| CN | 108796276 | A | 11/2018 |
| JP | S6130642 | A | 2/1986 |
| JP | S6230830 | A | 2/1987 |

OTHER PUBLICATIONS

Okamoto, H.. (1993) "Au-In (Gold-Indium)" J. Phase Equilibria. 14: 532.

Corti, C. W. (2004) "Blue black and purple! The special colours of gold" in The Santa Fe Symposium on Jewelry Manufacturing Technology 2004.

Cretu, C.; Van Der Lingen, E. (1999) "Coloured gold alloys". Gold Bulletin. 32(4): 115.

Van der Lingen, E. (2014) "Aspects of coloured precious metal intermetallic compounds". Journal of the Southern African Institute of Mining and Metallurgy. 114: 137-144.

Corti, C. W.; Van Der Lingen, E. (2016) "Special Colors of Precious Metal Jewelry: Present and Future" in The Santa Fe Symposium on Jewelry Manufacturing Technology 2016.

* cited by examiner

*Primary Examiner* — Xiaowei Su
(74) *Attorney, Agent, or Firm* — Law Offices of Albert Wai-Kit Chan, PLLC

(57) ABSTRACT

This invention provides a jewelry alloy which improves mechanical properties of $AuIn_2$ while preserving its attractive blue hue. In one embodiment, said mechanical properties comprises fracture toughness and hardness. In one embodiment, said jewelry alloy consist essentially of 43.0 to 49.0 wt % Au; 51.0 to 57.0 wt % In; 0.001 to 1.0 wt % of one or more elements selected from the group consisting of Fe and Ge; and 0.001 to 1.0 wt % of one or more elements selected from the group consisting of Rh, Ir and Ru.

10 Claims, No Drawings

JEWELRY ALLOY

FIELD OF THE INVENTION

The present invention relates to the compositions of gold alloys with attractive blue color and improved fracture resistance and hardness. The invention also relates to an ornament or a piece of jewelry comprising at least one component made of such alloys.

BACKGROUND OF THE INVENTION

Gold alloys based on intermetallic compounds such as $AuAl_2$, $AuGa_2$ and $AuIn_2$ have been of particular interest to the jewelry industry due to their fancy colors. For example, $AuAl_2$, which can be hallmarked as 18-karat, is known as "purple gold" due to its intense purple hue; $AuGa_2$ and $AuIn_2$ are known as "blue gold"; among them $AuGa_2$, which can be hallmarked as 14-karat, displays a slight bluish hue only and appears more grayish; While $AuIn_2$, which can be hallmarked as 11-karat, has a light clear blue color and is more attractive than $AuGa_2$.

However, the use of these colored gold alloys in jewelry manufacturing is limited because of the intrinsic brittleness of gold intermetallic compounds. Upon impact these alloys will easily fracture into pieces. One approach to improve the mechanical properties of these alloys is the modification of alloy compositions, usually by a slight deviation from the stoichiometric composition of $AuX_2$, or by the addition of a small amount of other alloying elements. In these ways, more ductile phases are formed, or grain refinement is achieved to strengthen the crystal structure, without the sacrifice of the distinct colors of $AuX_2$. For example, U.S. Pat. No. 6,929,776 disclosed an $AuAl_2$ based purple gold alloyed with 0.5 to 4 wt % Pd and 1 to 2 wt % Ni to improve fracture toughness, which can withstand Rockwell B hardness testing of 100 kg load without shattering. In JP Patent 61-30642, the $AuAl_2$ stoichiometric composition was slightly deviated and alloyed with 0.5 to 5 wt % of one or more elements selected among Si, Mg, Ca, Zn and Mn to reduce the brittleness of $AuAl_2$ based purple gold and provide workability. In CN Patent 102676864, the workability and ductility of $AuAl_2$ based purple gold were improved by alloying with 0.3 to 0.7 wt Cu and 0.03 to 0.5 wt % of at least one rare earth metals selected from La. Ce, Pr, Nd, Gd, Tb, Dy, Ho, Er, Tm; Lu, Sc and Y.

The alloying elements mentioned in U.S. Pat. No. 6,929,776, JP Patent 61-30642 and CN Patent 102676864 do not produce the same strengthening effect in $AuIn_2$ based blue gold, however. To make it feasible to manufacture $AuIn_2$ based blue gold jewelry, it is therefore necessary to find new ways to overcome its two major intrinsic drawbacks, i.e., brittleness and low hardness. $AuIn_2$ (46.2 wt % Au and 53.8 wt % In) is soft as its Vickers hardness is 49 HV only, which is not satisfactory for jewelry manufacturing. The brittleness of $AuIn_2$ can be demonstrated by shattering in Rockwell B hardness test with a 100 kg load. According to U.S. Pat. No. 6,929,776, being able to withstand Rockwell B hardness test is perceived as an empirical measure that the alloy is suitable for manufacturing jewelry. If the alloy shatters or cracks during Rockwell B hardness test, it is too brittle to be used in jewelry manufacturing. If the alloy can withstand Rockwell B hardness test with no formation of cracks, it is deemed to have enough fracture resistance for jewelry manufacturing.

SUMMARY OF THE INVENTION

Therefore, it is an object of the present invention to substantially improve both the fracture resistance and hardness of $AuIn_2$ based gold alloy, by providing a novel $AuIn_2$ based gold alloy which contains at least two other alloying elements. It is important to stress the synergistic effect of using a combination of alloying elements to produce the desired grain refinement, which in turn results in the improvement of both the fracture resistance and hardness at the same time. If the alloying elements are not added in a specific combination, both the fracture resistance and hardness cannot be improved at the same time; that is to say, the alloy becomes harder but lacks fracture: resistance, or the alloy becomes more fracture resistance but soft.

It is another object of the present invention to provide a novel $AuIn_2$ based gold alloy comprising at least two other alloying elements, which can withstand Rockwell B hardness test with a 100 kg load without shattering or formation of cracks.

It is another object of the present invention to provide a novel $AuIn_2$ based gold alloy comprising at least two other alloying elements, which has a \Tickers hardness comparable to that of a common sterling silver alloy. Preferably, the Vickers hardness of this alloy is at least 70 HV.

It is another object of the present invention to provide a novel $AuIn_2$ based gold alloy comprising at least two other alloying elements, which offers an advantageous compromise among fracture resistance, hardness and color to meet the mechanical and aesthetic requirements of the field of jewelry manufacturing, thereby maximizing the fracture resistance and hardness, while avoiding the loss of blue hue. The blue hue can be measured by CIELAB coordinates, which is a 3-dimensional measuring system for colors. The U' axis defines black at 0 and white at 100 to measure the lightness, the a* axis defines red at positive values and green at negative values to measure the red-green component, the b* axis defines yellow at positive values and blue at negative values to measure the yellow-blue component.

DETAILED DESCRIPTION OF THE INVENTION

This invention provides a jewelry alloy which improves mechanical properties of $AuIn_2$ while preserving its attractive blue hue. In one embodiment, said mechanical properties comprises fracture toughness and hardness. In one embodiment, said jewelry alloy consist essentially of 43.0 to 49.0 it % Au; 51.0 to 57.0 wt In; 0.001 to 1.0 wt % of one or more elements selected from the group consisting of Fe and Ge; and 0.001 to 1.0 wt % of one or more elements selected from the group consisting of Rh, Ir and Ru.

In one embodiment, said jewelry alloy consists essentially of 43.0 to 49.0 wt % Au; 51.0 to 57.0 wt % In; 0.001 to 1.0 wt % of Fe or Ge; and 0.001 to 1.0 wt % of Rh, Ir or Ru.

In one embodiment, said jewelry alloy consists essentially of 43.0 to 49.0 wt % Au; 51.0 to 57.0 wt % In; 0.001 to 1.0 wt % of Fe; and 0.001 to 1.0% of Ir.

In one embodiment, said jewelry alloy consists essentially of 43.0 to 49.0 wt % Au; 51.0 to 57.0 wt In; 0.001 to 1.0 wt % of Ge; and 0.001 to 1.0 wt % of Ru.

In one embodiment, said jewelry alloy consists essentially of 44.5 to 47.5 wt % Au; 52.5 to 55.5 wt % In; 0.01 to 0.5 wt % of one or more elements selected from the group consisting of Fe and Ge; and 0.01 to 0.5 wt % of one or more elements selected from the group consisting of Rh, Ir and Ru.

In one embodiment, said jewelry alloy consists essentially of 44.5 to 47.5 wt % Au, 52.5 to 55.5 wt % In, and a combination of elements selected from the group consisting of: 0.01 to 0.5 wt % of Fe, and 0.01 to 0.5 wt % of Rh; 0.01 to 0.5 wt % of Fe, and 0.01 to 0.5 wt % of Ir; 0.01 to 0.5 wt % of Fe, and 0.01 to 0.5 wt % of Ru; 0.01 to 0.5 wt % of Ge, and 0.01 to 0.5 wt % of Rh; 0.01 to 0.5 wt % of Ge, and 0.01 to 0.5 wt % of Ir; and 0.01 to 0.5% of Ge, and 0.01 to 0.5 wt % of Ru.

In one embodiment, said jewelry alloy consists essentially of 46.1 wt % Au, 53.7 wt % In and a combination of elements selected from the group consisting of: 0.1 wt % Fe and 0.1 wt % Rh; 0.1 wt % Fe and 0.1 wt % Ir; 0.1 wt % Fe and 0.1 wt % Ru; 0.1 wt % Ge and 0.1 wt % Rh; 0.1 wt % Ge and 0.1 wt % Ir; and 0.1 wt % Ge and 0.1 wt % Ru.

In one embodiment, said jewelry alloy has one or more of the following properties: i) capable of withstanding a Rockwell B hardness test with no formation of cracks; ii) a Vickers hardness of at least 70 HV; and iii) CIELAB coordinates with a b* value not higher than −3.9 and an a* value not higher than −3.4.

In one embodiment, said jewelry alloy has similar color but increased fracture resistance and hardness as compared to stoichiometric $AuIn_2$.

In one embodiment, this invention provides a piece of jewelry or ornament comprising at least one component made of the jewelry alloy of this invention.

In one embodiment, the present invention provides a $AuIn_2$ based gold alloy. In another embodiment, said alloy is able to withstand Rockwell B hardness test with a 100 kg load without shattering or formation of cracks. In yet another embodiment, said alloy has a Vickers hardness of at least 70 HV. In a further embodiment, said alloy has a b* value of CIELAB coordinates not higher than −3.9, and an a* value of CIELAB coordinates not higher than −3.4.

In one embodiment, the gold alloy comprises 43.0 to 49.0 wt % Au, 51.0 to 57.0 wt % In, 0.001 to 1.0 wt % of at least one Hof the alloying elements Fe and Ge, and 0.001 to 1.0 wt % of at least one of the alloying elements Rh, Ir and Ru, the respective percentages of all elements of the alloy adding up to 100%.

In one embodiment, the gold alloy comprises 44.5 to 47.5 wt % Au, 52.5 to 55.5 wt % In, 001 to 0.5 wt % of at least one of the alloying elements Fe and Ge, and 0.01 to 0.5 wt % of at least one of the alloying elements Rh, Ir and Ru, the respective percentages of all elements of the alloy adding up to 100%.

In one embodiment, the gold alloy comprises 44.5 to 47.5 wt Au, 52.5 to 55.5 wt % In, 0.01 to 0.5 wt % of Fe, and 0.01 to 0.5 wt % of Rh, the respective percentages of all elements of the alloy adding up to 100%.

In one embodiment, the gold alloy comprises 44.5 to 47.5 wt % Au, 52.5 to 55.5 wt % In, 0.01 to 0.5 wt % of Fe, and 0.01 to 0.5 wt % of Ir, the respective percentages of all elements of the alloy adding up to 100%.

In one embodiment, the gold alloy comprises 44.5 to 47.5 wt % Au, 52.5 to 55.5 wt % In, 0.01 to 0.5 wt % of Fe, and 0.01 to 0.5 wt % of Ru, the respective percentages of all elements of the alloy adding up to 100%.

In one embodiment, the gold alloy comprises 44.5 to 47.5 wt % Au, 52.5 to 55.5 wt % In, 0.01 to 0.5 wt of Ge, and 0.01 to 0.5 wt % of Rh, the respective percentages of all elements of the alloy adding up to 100%.

In one embodiment, the gold alloy comprises 44.5 to 47.5% Au, 52.5 to 55.5 wt % In, 0.01 to 0.5 wt % of Ge, and 0.01 to 0.5 wt % of Ir, the respective percentages of all elements of the alloy adding up to 100%.

In one embodiment, the gold alloy comprises 44.5 to 47.5 wt % Au 52.5 to 55.5 wt % In, 0.01 to 0.5 wt % of Ge, and 0.01 to 0.5 wt % of Ru, the respective percentages of all elements of the alloy adding up to 100%.

In one embodiment, the gold alloy comprises 46.1 wt % Au, 53.7 wt % In, 0.1 wt % Fe and 0.1 wt % Ir.

In one embodiment, the gold alloy comprises 46.1 wt % Au, 53.7 wt % in, 0.1 wt % Ge and 0.1 wt % Ru.

The invention will be better understood by reference to the following examples, but those skilled in the art will readily appreciate that the specific examples detailed are only illustrative, and are not meant to limit the invention as described herein, which is defined by the claims which follow thereafter.

Throughout this application, various references or publications are cited. Disclosures of these references or publications in their entireties are hereby incorporated by reference into this application in order to more fully describe the state of the art to which this invention pertains. It is to be noted that the transitional term "comprising", which is synonymous with "including", "containing" or "characterized by", is inclusive or open-ended and does not exclude additional, un-recited elements or method steps.

The following alloys were produced according to the conditions set out in Table 1 below Alloys 1 to 6 were produced for comparative purpose, while Alloys 7 and 8 were produced in accordance with the present invention.

TABLE 1

| Alloy | Au wt % | In wt % | Rh wt % | Ir wt % | Ru wt % | Fe wt % | Ge wt % |
|---|---|---|---|---|---|---|---|
| 1 (comp.) | 46.2 | 53.8 | — | — | — | — | — |
| 2 (comp.) | 46.1 | 53.7 | 0.2 | — | — | — | — |
| 3 (comp.) | 46.1 | 53.8 | — | 0.1 | — | — | — |
| 4 (comp.) | 46.1 | 53.8 | — | — | 0.1 | — | — |
| 5 (comp.) | 46.1 | 53.8 | — | — | — | 0.1 | — |
| 6 (comp.) | 46.1 | 53.8 | — | — | — | — | 0.1 |
| 7 (inv.) | 46.1 | 53.7 | — | 0.1 | — | 0.1 | — |
| 8 (inv.) | 46.1 | 53.7 | — | — | 0.1 | — | 0.1 |

The fracture resistance, Vickers hardness of Alloys 1 to 8 are provided in Table 2. By comparing Alloys 7 and 8 with Alloys 2 to 6, it can be seen that the addition of at least two alloying elements mentioned in the embodiments is superior to the addition of only one alloying element, as improvement in both fracture resistance and hardness was seen in Alloys 7 and 8, thanks to the synergistic effect of using a combination of alloying elements. The CIELAB coordinates of Alloys 1, 7 and 8 are provided in Table 3 to compare the colors of Alloys 7 and 8 with the stoichiometric $AuIn_2$ (Alloy 1). The blue hue is preserved in Alloys 7 and 8.

The $AuIn_2$ based gold alloys of the present invention (Alloys 7 and 8) meet the three requirements of fracture resistance, hardness and color for the intended use in jewelry manufacturing. Alloys 7 and 8 therefore present a fracture resistance of being able to withstand Rockwell B hardness test with a 100 kg load, a Vickers hardness of at least 70 HV, and a b* value of CIELAB coordinates not higher than −3.9 and an a* value of CIELAB coordinates not higher than −3.4. In contrast, the alloys produced for comparative purpose (Alloys 1 to 6) do not meet the requirements of being both fracture resistant and hard enough at the same time.

As discussed above, the improvement in mechanical properties of $AuIn_2$ while preserving the attractive blue hue is attributed to a synergistic effect of using a combination of alloying elements. In one embodiment, it is expected that platinum-group metals having similar solubility in gold as Ir and Ru may be used interchangeably to produce similar effects on the resulting gold alloy. In another embodiment, among the group of platinum-group metals, Rh has very low solubility in gold similar to Ir and Ru.

TABLE 2

| Alloy | Fracture Resistance Withstand Rockwell B hardness test with a 100 kg load? | Vickers Hardness HV |
|---|---|---|
| 1 (comp.) | Shatters | 49 |
| 2 (comp.) | Yes | 56 |
| 3 (comp.) | Yes | 55 |
| 4 (comp.) | Yes | 55 |
| 5 (comp.) | Crack | 64 |
| 6 (comp.) | Crack | 66 |
| 7 (inv.) | Yes | 74 |
| 8 (inv.) | Yes | 77 |

TABLE 3

| Alloy | L* | a* | b* |
|---|---|---|---|
| 1 (comp.) | 79.32 | −3.73 | −4.22 |
| 7 (inv.) | 79.19 | −3.58 | −4.02 |
| 8 (inv.) | 79.37 | −3.55 | −4.09 |

What is claimed is:

1. A jewelry alloy, consisting essentially of:
a. 43.0 to 49.0 wt % Au;
b. 51.0 to 57.0 wt % In;
c. 0.001 to 1.0 wt % of one or more elements selected from the group consisting of Fe and Ge; and
d. 0.001 to 1.0 wt % of one or more elements selected from the group consisting of Rh, Ir and Ru.

2. The jewelry alloy of claim 1, consisting essentially of:
a. 43.0 to 49.0 wt % Au;
b. 51.0 to 57.0 wt % In;
c. 0.001 to 1.0 wt % of Fe or Ge; and
d. 0.001 to 1.0 wt % of Rh, Ir or Ru.

3. The jewelry alloy of claim 1, consisting essentially of:
a. 43.0 to 49.0 wt % Au;
b. 51.0 to 57.0 in; % In;
c. 0.001 to 1.0 wt % of Fe; and
d. 0.001 to 1.0 wt % of Ir.

4. The jewelry alloy of claim 1, consisting essentially of:
a. 43.0 to 49.0 wt % Au;
b. 51.0 to 57.0 in; % In;
c. 0.001 to 1.0 wt % of Ge; and
d. 0.001 to 1.0 wt % of Ru.

5. The jewelry alloy of claim 1, consisting essentially of:
a. 44.5 to 47.5 wt % Au;
b. 52.5 to 55.5 wt % In;
c. 0.01 to 0.5 wt % of one or more elements selected from the group consisting of Fe and Ge; and
d. 0.01 to 0.5 wt % of one or more elements selected from the group consisting of Rh, Ir and Ru.

6. The jewelry alloy of claim 1, consisting essentially of 44.5 to 47.5 wt % Au, 52.5 to 55.5 wt % In, and a combination of elements selected from the group consisting of:
a. 0.01 to 0.5 wt % of Fe, and 0.01 to 0.5 wt % of Rh;
b. 0.01 to 0.5 wt % of Fe, and 0.01 to 0.5 wt % of Ir;
c. 0.01 to 0.5 wt % of Fe, and 0.01 to 0.5 wt % of Ru;
d. 0.01 to 0.5 wt % of Ge, and 0.01 to 0.5 wt % of Rh;
e. 0.01 to 0.5 wt % of Ge, and 0.01 to 0.5 wt % of Ir; and
f. 0.01 to 0.5 wt % of Ge, and 0.01 to 0.5 wt % of Ru.

7. The jewelry alloy of claim 1, consisting essentially of 46.1 wt % Au, 53.7 wt % in and a combination of elements selected from the group consisting of:
a. 0.1 wt % Fe and 0.1 wt % Rh;
b. 0.1 wt % Fe and 0.1 wt % Ir;
c. 0.1 wt % Fe and 0.1 wt % Ru;
d. 0.1 wt % Ge and 0.1 wt % Rh;
e. 0.1 Wt % Ge and 0.1 wt % Ir; and
f. 0.1 wt % Ge and 0.1 wt % Ru.

8. The jewelry alloy of claim 1, said jewelry alloy has one or more of the following properties:
a. capable of withstanding a Rockwell B hardness test with no formation of cracks;
b. a Vickers hardness of at least 70 HV; and
c. CIELAB coordinates with a b* value not higher than −3.9 and an a* value not higher than −3.4.

9. The jewelry alloy of claim 1, said jewelry alloy has similar color but increased fracture resistance and hardness as compared to stoichiometric $AuIn_2$.

10. A piece of jewelry or ornament comprising at least one component made of the jewelry alloy of claim 1.

* * * * *